US010086386B2

(12) United States Patent
Kawabe et al.

(10) Patent No.: US 10,086,386 B2
(45) Date of Patent: Oct. 2, 2018

(54) COATING NOZZLE AND COATING DEVICE

(71) Applicant: HONDA MOTOR CO., LTD., Tokyo (JP)

(72) Inventors: Gaku Kawabe, Tochigi (JP); Shinya Murakami, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/426,141

(22) Filed: Feb. 7, 2017

(65) Prior Publication Data

US 2017/0225179 A1 Aug. 10, 2017

(30) Foreign Application Priority Data

Feb. 9, 2016 (JP) ..... 2016-022707

(51) Int. Cl.
*B05B 1/14* (2006.01)
*B05B 13/04* (2006.01)

(52) U.S. Cl.
CPC ..... *B05B 1/14* (2013.01); *B05B 13/0431* (2013.01)

(58) Field of Classification Search
USPC ..... 118/308, 313–315, 633
See application file for complete search history.

(56) References Cited

U.S. PATENT DOCUMENTS 3,117,029 A * 1/1964 Hines ..... B05B 5/0255 118/621
3,870,232 A 3/1975 Lacchia
8,464,653 B2 * 6/2013 Ebisawa ..... B05C 5/0208 118/300

FOREIGN PATENT DOCUMENTS

| | | |
|---|---|---|
| CA | 2070063 | 11/1992 |
| JP | S49-042742 | 4/1974 |
| JP | H05-177155 | 7/1993 |
| JP | 3732526 | 10/2005 |
| JP | 2006-007198 | 1/2006 |

OTHER PUBLICATIONS

Japanese Office Action dated Aug. 1, 2017, 2 pages.

* cited by examiner

*Primary Examiner* — Yewebdar T Tadesse
(74) *Attorney, Agent, or Firm* — Rankin, Hill & Clark LLP

(57) ABSTRACT

An object of the present invention is to provide a coating nozzle which has a plurality of discharge holes and which can reduce variations in the discharge of a coating material from the discharge holes. A coating nozzle (10) includes: a plurality of supply holes (40*a* to 40*t*) which are formed in a supply surface (35) so as to be aligned on a circle (D) with a first position (45) in the center; a plurality of discharge holes (50*a* to 50*t*) which are formed in a discharge surface (20) so as to be aligned on a straight line (L); and a plurality of communication hole paths (60*a* to 60*t*) which make the supply holes (40*a* to 40*t*) linearly communicate with the discharge holes (50*a* to 50*t*), respectively and in which the communication distances thereof are substantially equal to each other.

9 Claims, 9 Drawing Sheets

COATING NOZZLE AND COATING DEVICE

This application is based on and claims the benefit of priority from Japanese Patent Application No. 2016-022707, filed on 9 Feb. 2016, the content of which is incorporated herein by reference.

BACKGROUND OF THE INVENTION

Field of the Invention

The present invention relates to a coating nozzle and a coating device which includes the coating nozzle.

Related Art

Conventionally, when a target such as a vehicle body is coated with a coating material such as a paint, a device which includes a coating nozzle for jetting the coating material is used. In order to uniformly coat a target with a coating material, a coating device is proposed which includes a coating nozzle formed by linearly arranging a plurality of discharge holes (for example, see patent document 1).

Patent Document 1: Japanese Patent No. 3732526

SUMMARY OF THE INVENTION

However, in the coating device disclosed in patent document 1, when the coating material is supplied from a supply portion to discharge nozzles, variations in the discharge of the coating material from the discharge nozzles may be produced.

An object of the present invention is to provide a coating nozzle which has a plurality of discharge holes and which can reduce variations in the discharge of a coating material from the discharge holes. Another object of the present invention is to provide a coating device which includes the coating nozzle.

The present invention relates to a coating nozzle (for example, a coating nozzle 10 which will be described later) which discharges a coating material supplied from a coating material supply portion (for example, a coating material supply portion 8 which will be described later), the coating nozzle including: a discharge surface (for example, a discharge surface 20 which will be described later) which is arranged opposite a coating target (for example, a target T which will be described later); a chamber portion (for example, a chamber portion 30 which will be described later) which communicates with the coating material supply portion; a supply surface (for example, a supply surface 35 which will be described later) which forms an inner surface of the chamber portion and which is arranged substantially parallel to the discharge surface; a plurality of supply holes (for example, supply holes 40*a* to 40*t* which will be described later) which are formed, with a first position (for example, a first position 45 which will be described later) in a center, therearound in the supply surface; a plurality of discharge holes (for example, discharge holes 50*a* to 50*t* which will be described later) which are formed in the discharge surface so as to be aligned on at least one substantially straight line (for example, a straight line L which will be described later); and a plurality of communication hole paths (for example, communication hole paths 60*a* to 60*t* which will be described later) which make the supply holes respectively communicate with the discharge holes and whose communication distances (lengths) are substantially equal to each other.

The coating nozzle of the present invention includes: the supply holes which are formed, with the first position in the center, therearound in the supply surface; the discharge holes which are formed in the discharge surface so as to be aligned on at least one substantially straight line; and the communication hole paths which make the supply holes respectively communicate with the discharge holes and whose communication distances (lengths) are substantially equal to each other.

In this way, in the coating device (coating nozzle) of the present invention, the coating material is supplied with the same pressure to the supply holes, and since the communication distances of the communication hole paths are substantially equal to each other, the coating material is discharged from the discharge holes with the same timing. In this way, the coating device (coating nozzle) of the present invention can perform highly accurate discharge on the target.

In the coating device (coating nozzle) of the present invention, the coating material is supplied from the same (one) chamber portion to the supply holes. In this way, the coating device (coating nozzle) of the present invention stops the discharge of the coating material from the discharge holes with the same timing.

Preferably, the supply holes are formed in the supply surface so as to be aligned on a circle (for example, a circle D which will be described later) with the first position in the center.

In this way, since the supply holes are arranged on the circle with the first position in the center, the communication distances of the communication hole paths which make the supply holes communicate with the discharge holes can be easily and reliably made equal to each other, and thus the above effects are more reliably achieved.

Preferably, when the straight line that is a direction in which the discharge holes are arranged is a reference line, as the discharge holes are located closer to the first position in the center, the discharge holes communicate with the supply holes which are located farther from the reference line.

In this way, as the discharge holes are located closer to the first position, the discharge holes communicate with the supply holes which are located farther from the reference line, and thus the communication distances of the communication hole paths which make the supply holes communicate with the discharge holes can be easily and reliably made equal to each other, with the result that the above effects are more reliably achieved.

Preferably, in the coating device (coating nozzle) of the present invention, a distance (for example, a distance F1 which will be described later) from one end to the other end of the discharge holes which are formed so as to be aligned on at least one substantially straight line is longer than a diameter (for example, a diameter F2 which will be described later) of the circle on which the supply holes are formed so as to be aligned.

In this way, the coating device (coating nozzle) of the present invention can coat, with the coating material, a region which is longer than a (length in a predetermined direction) region where the supply holes are formed. In this way, with the coating device (coating nozzle) of the present invention, it is possible to solve problems that occur in a coating device (coating nozzle) in which a distance from one end to the other end of a plurality of discharge holes is longer than the length of a region in a predetermined direction where a plurality of supply holes are formed. In this way, in the coating device (coating nozzle) of the present invention, as compared with the distance from one end to the other end of the discharge holes, the length of the diameter of the chamber portion and the like can be reduced. In this way, it is possible to reduce the size of the coating device (coating nozzle) of the present invention.

Preferably, in the coating device (coating nozzle) of the present invention, the supply surface is formed concentrically with the first position in the center which is the center of the circle on which the supply holes are arranged. In this way, with the coating device (coating nozzle) of the present invention, it is possible to supply the coating material to the supply holes with a more uniform pressure.

Preferably, in the coating device (coating nozzle) of the present invention, the communication hole paths intersect a normal to the discharge surface. In this way, the coating device (coating nozzle) of the present invention can be adjusted such that the communication distances of the communication hole paths are substantially equal to each other.

Preferably, in the coating device (coating nozzle) of the present invention, the discharge holes are arranged so as to be aligned on at least one straight line which is perpendicular to a normal that is extended vertically from the first position to the discharge surface. In this way, the coating device (coating nozzle) of the present invention is easily adjusted such that the communication distances of the communication hole paths are substantially equal to each other.

Preferably, in the coating device (coating nozzle) of the present invention, the supply holes are substantially spaced in a circumferential direction of the circle and are substantially equal to each other in diameter. In this way, in the coating device (coating nozzle) of the present invention, the pressure of the coating material in the supply holes is uniform, and thus the coating material is discharged from the discharge holes with the same timing.

Preferably, in the coating device (coating nozzle) of the present invention, the discharge holes are substantially spaced in a direction of the straight line and are substantially equal to each other in diameter. In this way, the coating device (coating nozzle) of the present invention discharges the coating material from the discharge holes with the same timing.

According to the present invention, it is possible to provide a coating nozzle which includes a plurality of discharge holes and which can reduce variations in the discharge of a coating material from the discharge holes. Moreover, according to the present invention, it is possible to provide a coating device which includes the coating nozzle.

DETAILED DESCRIPTION OF THE INVENTION

Embodiments of the present invention will be described in detail below with reference to drawings. In the second and subsequent embodiments, the description of the same configurations as in the first embodiment will be omitted as necessary.

First Embodiment

Figure 1:
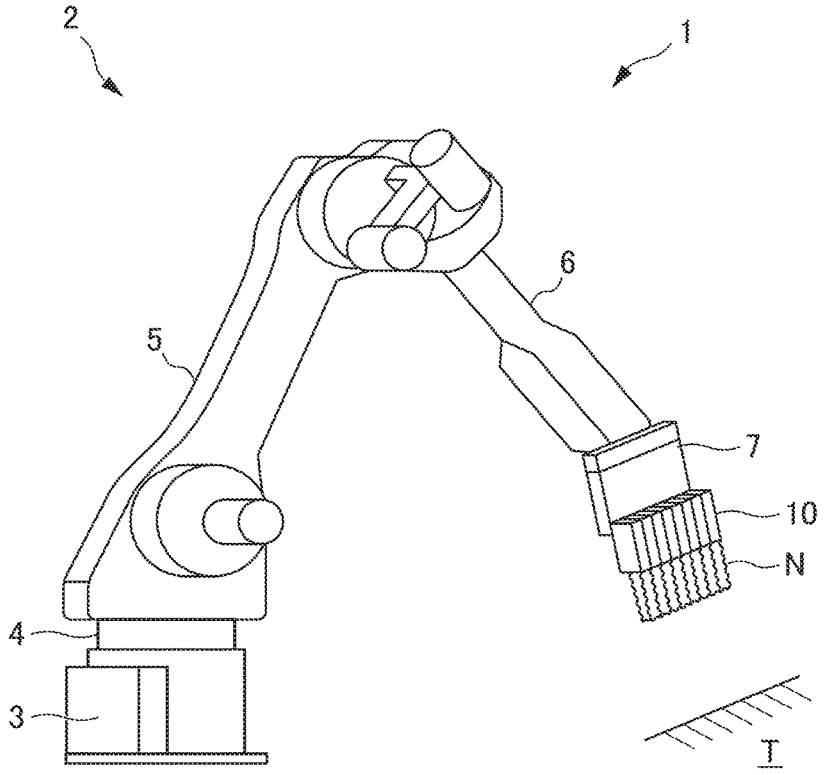
FIG. 1 is a diagram showing the appearance of a coating device according to a first embodiment.
Figure 2:
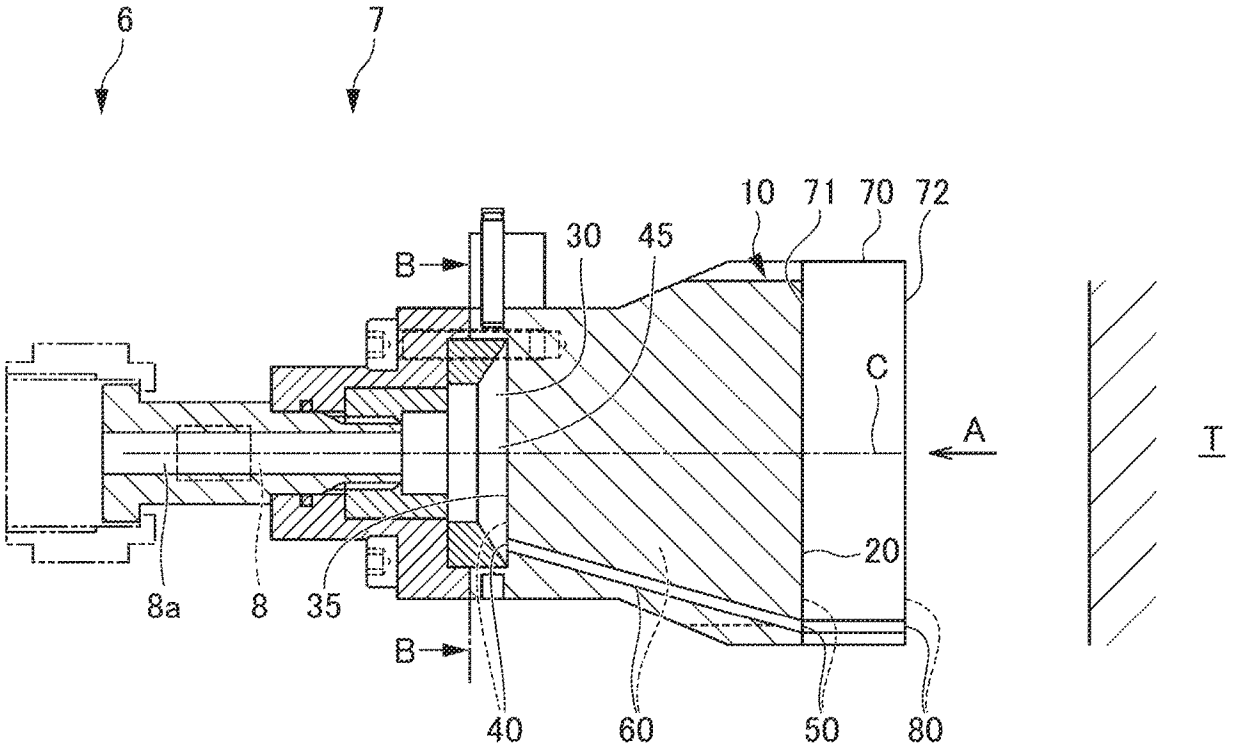
FIG. 2 is a cross-sectional view showing the configuration of a coating nozzle according to the first embodiment.
Figure 3:
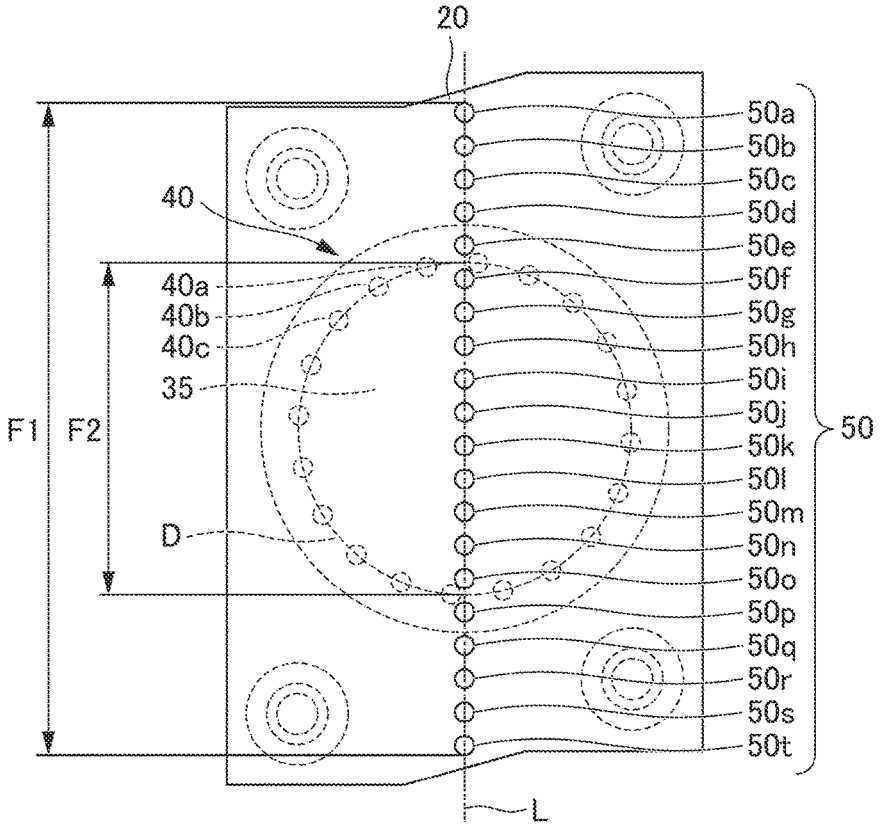
FIG. 3 is a diagram when the coating nozzle in FIG. 2 is viewed from the direction of an arrow A, and is also a perspective view illustrating the configuration of the coating nozzle.
Figure 4:
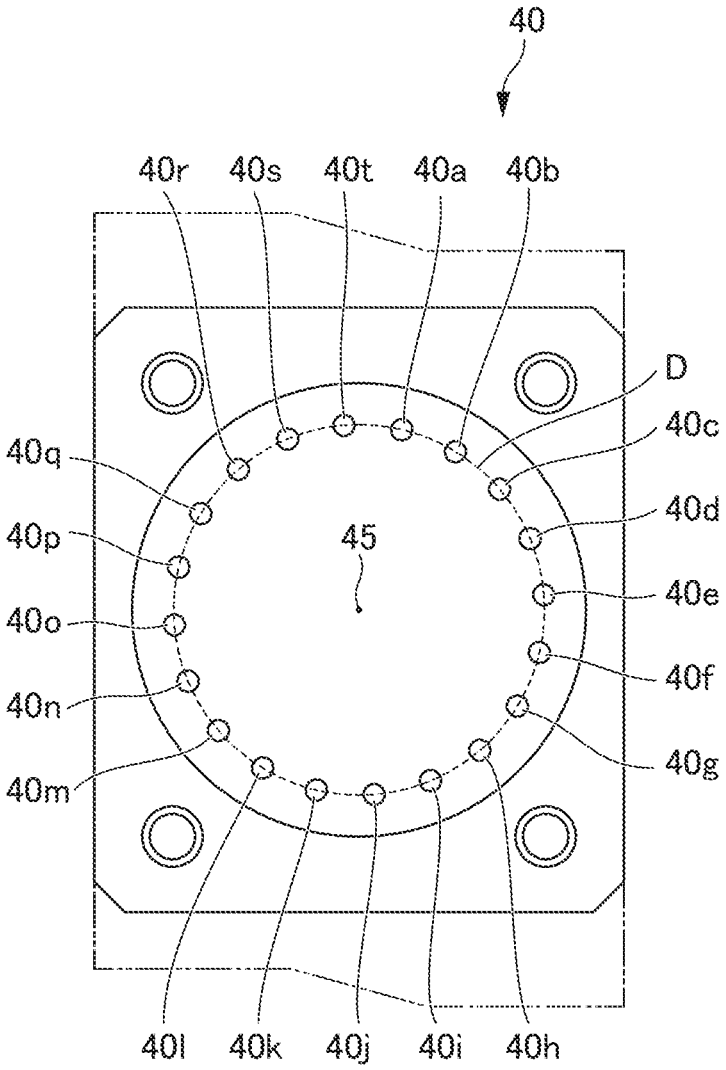
FIG. 4 is a cross-sectional view taken along line B-B in FIG. 2.
Figure 5:
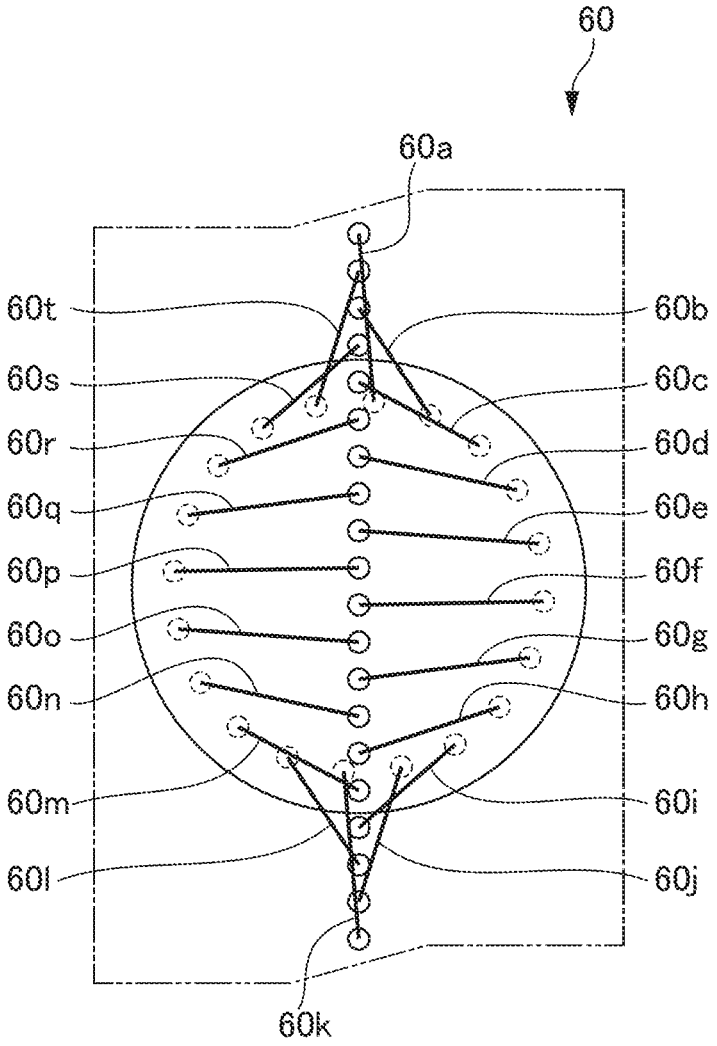
FIG. 5 is a diagram illustrating a plurality of communication hole paths in the coating nozzle according to the first embodiment.
Figure 6:
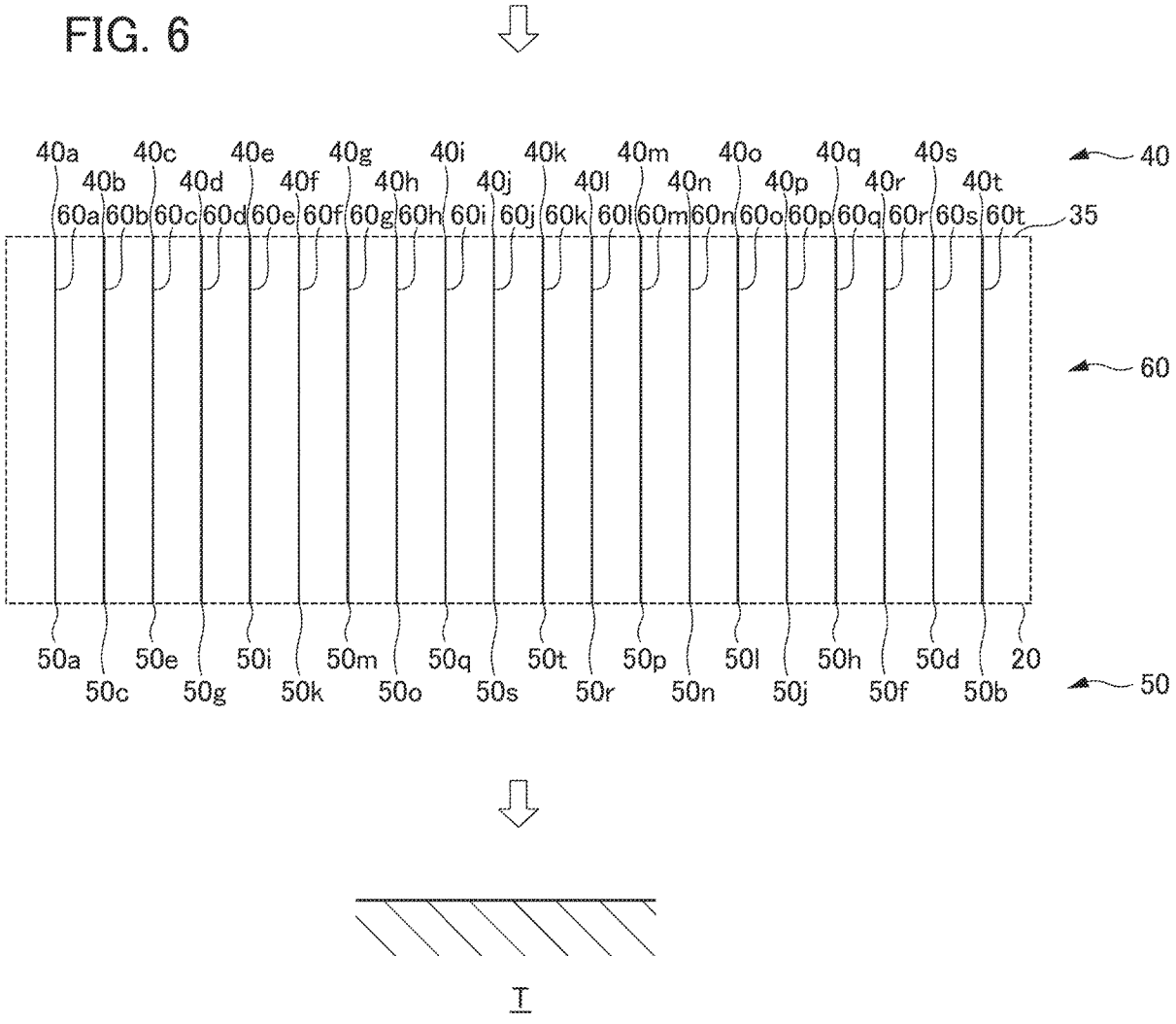
FIG. 6 is a schematic view illustrating the communication hole paths in the coating nozzle according to the first embodiment.

A coating device 1 according to the first embodiment of the present invention will first be described with reference to FIGS. 1 to 6. FIG. 1 is a diagram showing the appearance of the coating device 1 according to the first embodiment. FIG. 2 is a cross-sectional view showing the configuration of a coating nozzle 10 according to the first embodiment. FIG. 3 is a diagram when the coating nozzle 10 in FIG. 2 is viewed from the direction of an arrow A, and is also a perspective view illustrating the configuration of the coating nozzle 10. However, in FIG. 3, for convenience, an attachment 70 which will be described later is unillustrated. FIG. 4 is a cross-sectional view taken along line B-B in FIG. 2. FIG. 5 is a diagram illustrating a plurality of communication hole paths 60*a* to 60*t* in the coating nozzle 10 according to the first embodiment. FIG. 6 is a schematic view illustrating the communication hole paths 60*a* to 60*t* in the coating nozzle 10 according to the first embodiment.

As shown in FIG. 1, the coating device 1 of the present embodiment is a device which coats a target T (for example, a vehicle body) with a coating material (for example, a paint). In the present embodiment, the coating device 1 includes an articulated robot 2. The articulated robot 2 includes a base portion 3, a pivot portion 4 which is provided on the upper surface side of the base portion 3, a first arm 5 which is pivotally coupled through the pivot portion 4 to the base portion 3, a second arm 6 which is coupled to the first arm 5 through a joint portion and a tip end portion 7 which is coupled to the second arm 6 through a joint portion.

As shown in FIG. 2, the coating device 1 includes the coating nozzle 10. The coating nozzle 10 is attached to the tip end portion 7. The coating nozzle 10 is arranged so as to communicate with a coating material supply portion 8 which communicates with a coating material supply source (not shown). The coating nozzle 10 discharges, toward the target T, the coating material supplied from the coating material supply portion 8.

As shown in FIG. 2, the coating nozzle 10 includes a discharge surface 20, a chamber portion 30, a supply surface 35 which forms the inner surface of the chamber portion 30, a supply hole group 40, a discharge hole group 50 and a communication hole path group 60.

As shown in FIG. 2, the discharge surface 20 is a surface which is arranged opposite the target T. The discharge surface 20 is formed substantially parallel to the supply surface 35. As shown in FIGS. 2 and 3, in the discharge surface 20, the discharge hole group 50 is formed. The discharge hole group 50 will be described in detail later.

As shown in FIG. 2, the chamber portion 30 is arranged so as to communicate with the coating material supply portion 8 (coating material supply pipe 8*a*). The chamber portion 30 is a portion which receives the supply of a viscous material from the coating material supply portion 8 and which supplies the viscous material to the supply hole group 40. The chamber portion 30 stores a predetermined amount of viscous material, and when the viscous material is further fed from the coating material supply portion 8, the chamber portion 30 supplies the viscous material to the side of the supply hole group 40. Here, the chamber portion 30 is brought into an on-state where the viscous material is supplied to the supply hole group 40/an off-state where the supply of the viscous material is stopped by the turning on and off of a liquid feeding pump (not shown) included in the coating material supply portion 8.

As shown in FIG. 2, the supply surface 35 forms the inner surface of the chamber portion 30. The supply surface 35 is the inner surface of the chamber portion 30 on the side of the discharge surface 20. The supply surface 35 is a surface which is arranged substantially perpendicularly to a direction (flow direction) in which the viscous material is supplied. The supply surface 35 is also a surface which is arranged substantially parallel to the discharge surface 20.

As shown in FIG. 2, the attachment 70 is attached to the tip end of the coating nozzle 10. In the attachment 70, a vertical penetration hole group 80 is formed that is formed with a plurality of vertical penetration holes which are extended vertically from its base end surface 71 to a tip end surface 72 so as to penetrate. The vertical penetration hole group 80 is formed so as to coincide with the position of the discharge hole group 50 in the discharge surface 20, and a plurality of vertical penetration holes respectively communicate with a plurality of discharge holes which will be described later. In this way, the attachment 70 can regulate the direction of the flow of the material to the vertical direction, and is attached according to the viscosity, the flow rate, the posture and the like of the material.

As shown in FIGS. 3 and 4, (the outer edge of) the supply surface 35 is formed concentrically with a circle D with a first position 45 in the center. As shown in FIGS. 3 and 4, in the supply surface 35, the supply hole group 40 is formed.

As shown in FIGS. 1 to 3, the supply hole group 40 has a plurality of supply holes 40*a* to 40*t*. In the present embodiment, the supply hole group 40 has 20 supply holes.

The supply holes 40*a* to 40*t* are formed so as to be aligned on the circle D with the first position 45 in the center. In the present embodiment, the supply holes 40*a* to 40*t* are substantially spaced in the circumferential direction of the circle D and are substantially equal to each other in diameter. Here, in the present embodiment, the coating material supply pipe 8*a* is arranged, in cross-sectional view, concentrically with the circle D with the first position 45 in the center.

As shown in FIGS. 2 and 3, the discharge hole group 50 has a plurality of discharge holes 50*a* to 50*t*. In the present embodiment, the discharge hole group 50 has 20 discharge holes. The number of discharge holes is equal to that of supply holes. The diameter of the discharge hole is substantially equal to that of the supply hole.

The discharge holes 50*a* to 50*t* are formed so as to be aligned substantially linearly on the discharge surface 20. In the present embodiment, the discharge holes 50*a* to 50*t* are arranged so as to be aligned on one straight line L. The discharge holes 50*a* to 50*t* are substantially spaced in the direction of the straight line L and are substantially equal to each other in diameter.

Here, in the present embodiment, the straight line L is preferably perpendicular to a normal C which is extended from the first position 45 to the discharge surface 20. The discharge holes 50*a* to 50*t* are preferably arranged so as to be aligned on the straight line L perpendicular to the normal C which is extended from the first position 45 to the discharge surface 20. In other words, the discharge holes 50*a* to 50*t* are preferably arranged in the diametrical direction of the circle D when viewed from the direction of the arrow A (see FIG. 2 and FIG. 3).

As shown in FIG. 3, a distance F1 from one end to the other end of the discharge holes 50*a* to 50*t* is longer than a diameter F2 of the circle D where the supply holes 40*a* to 40*t* are formed so as to be aligned. In other words, the coating nozzle 10 can coat the target T with the coating material in a width which is longer than the diameter F2 of the circle D where the supply holes 40*a* to 40*t* are formed so as to be aligned.

As shown in FIGS. 2, 5 and 6, the communication hole path group 60 has a plurality of communication hole paths 60*a* to 60*t*. The communication hole paths 60*a* to 60*t* are hole paths which make the supply holes 40*a* to 40*t* linearly communicate with the discharge holes 50*a* to 50*t*, respectively.

In FIG. 5, the communication hole paths 60*a* to 60*t* are shown by indicating the center lines of the communication hole paths.

The communication distances (lengths) of the communication hole paths 60*a* to 60*t* are substantially equal to each other. The communication hole paths 60*a* to 60*t* are formed by devising the arrangement of the supply holes 40*a* to 40*t* and the discharge holes 50*a* to 50*t* such that the communication distances (lengths) are substantially equal to each other. The communication hole paths 60*a* to 60*t* are adjusted by adjusting the directions and angles of the extension thereof (see FIG. 5) such that the communication distances (lengths) are substantially equal to each other (see FIG. 6). Here, that the communication distances (lengths) are substantially equal to each other means that for example, variations are within 10%, are preferably within 5% and are further preferably within 3%.

Here, as is understood from FIGS. 3 to 5, when the straight line L which is the direction of the arrangement of the discharge holes 50*a* to 50*t* is assumed to be a reference line, as the discharge holes 50*a* to 50*t* are located closer to the first position 45 located in the center, the discharge holes 50*a* to 50*t* communicate with the supply holes which are located farther from the straight line L that is the reference line. In this way, the communication distances of the communication hole paths 60*a* to 60*t* which make the supply holes communicate with the discharge holes are easily made equal to each other.

The communication hole paths 60*a* to 60*t* are arranged so as to intersect the normal to the discharge surface 20. The communication hole paths 60*a* to 60*t* are not arranged so as to be extended perpendicularly to the supply surface 35 and the discharge surface 20 but are formed by adjusting the directions and angles of the extension such that the communication distances (lengths) are substantially equal to each other.

The communication hole paths 60*a* to 60*t* are formed by the communication of the supply holes 40*a* to 40*t* with the discharge holes 50*a* to 50*t*, and are specifically as follows.

As shown in FIG. 6, the communication hole path 60*a* makes the supply hole a communicate with the discharge hole 50*a*. The communication hole path 60*b* makes the supply hole b communicate with the discharge hole 50*c*. The communication hole path 60*c* makes the supply hole c communicate with the discharge hole 50*e*. The communication hole path 60*d* makes the supply hole d communicate with the discharge hole 50*g*. The communication hole path 60*e* makes the supply hole e communicate with the discharge hole 50*i*. The communication hole path 60*f* makes the supply hole f communicate with the discharge hole 50*k*. The communication hole path 60*g* makes the supply hole g communicate with the discharge hole 50*m*. The communication hole path 60*h* makes the supply hole h communicate with the discharge hole 50*o*. The communication hole path 60*i* makes the supply hole i communicate with the discharge hole 50*q*. The communication hole path 60*j* makes the supply hole j communicate with the discharge hole 50*s*. The communication hole path 60*k* makes the supply hole k communicate with the discharge hole 50*t*. The communication hole path 60*l* makes the supply hole l communicate with the discharge hole 50*r*. The communication hole path 60*m* makes the supply hole m communicate with the discharge hole 50*p*. The communication hole path 60*n* makes the supply hole n communicate with the discharge hole 50*n*. The communication hole path 60*o* makes the supply hole o communicate with the discharge hole 50*l*. The communication hole path 60*p* makes the supply hole p communicate with the discharge hole 50*j*. The communication hole path 60*q* makes the supply hole q communicate with the discharge hole 50*h*. The communication hole path 60*r* makes the supply hole r communicate with the discharge hole 50*f*. The communication hole path 60*s* makes the supply hole s communicate with the discharge hole 50*d*. The communication hole path 60*t* makes the supply hole t communicate with the discharge hole 50*b*.

In the present embodiment, the communication hole paths 60*a* to 60*t* respectively make the supply holes 40*a* to 40*t* communicate with the discharge holes 50*a* to 50*t* as described above, and are set as in the present embodiment by optimally adjusting the distance of the discharge surface 20 and supply surface 35.

Next, the operation of the coating device 1 will be described briefly.

The coating device 1 first drives the liquid feeding pump in the coating material supply portion 8 so as to supply the coating material to the chamber portion 30 (supply ON). The coating material supplied to the chamber portion 30 is fed to the supply holes 40*a* to 40*t* with the first position 45 in the center with the same pressure.

Then, the coating material fed with the same pressure to the supply holes 40*a* to 40*t* is passed through the communication hole paths 60*a* to 60*t* and is discharged from the discharge holes 50*a* to 50*t* toward the target T. As described above, the coating device 1 simultaneously discharges the coating material from the discharge holes 50*a* to 50*t* arranged at the tip end of the coating nozzle 10 (discharge ON).

Here, since the coating material is supplied with the same pressure to the supply holes 40*a* to 40*t*, and the communication distances of the communication hole paths 60*a* to 60*t* are substantially equal to each other, the coating device 1 (coating nozzle 10) discharges the coating material from the discharge holes 50*a* to 50*t* with the same timing.

Then, in a state where the coating material is discharged, the coating device 1 moves the coating nozzle 10 in a direction perpendicular to (intersecting) the direction of the straight line L. In this way, the coating device 1 (coating nozzle 10) uniformly coats the target T with the coating material.

Then, the coating device 1 stops the drive of the liquid feeding pump in the coating material supply portion 8 so as to stop the supply of the coating material to the chamber portion 30 (supply OFF). In this way, since the supply of the coating material from the chamber portion 30 through the supply holes 40*a* to 40*t* to the communication hole paths 60*a* to 60*t* is stopped, the coating device 1 stops the discharge of the coating material from the discharge holes 50*a* to 50*t* arranged at the tip end of the coating nozzle 10 (discharge OFF).

Here, since the coating material is supplied from the same (one) chamber portion 30 to the supply holes 40*a* to 40*t*, the coating device 1 (coating nozzle 10) stops the discharge of the coating material from the discharge holes 50*a* to 50*t* with the same timing.

According to the present embodiment, the following effects are achieved.

In the present embodiment, the coating nozzle 10 includes: the supply holes 40*a* to 40*t* which are formed in the supply surface 35 so as to be aligned on the circle D with the first position 45 in the center; the discharge holes 50*a* to 50*t* which are formed in the discharge surface 20 so as to be aligned on the substantially straight line L; and the communication hole paths 60*a* to 60*t* which make the supply holes 40*a* to 40*t* linearly communicate with the discharge holes 50*a* to 50*t*, respectively and in which the communication distances (lengths) thereof are substantially equal to each other.

In this way, in the coating device 1 (coating nozzle), the coating material is supplied with the same pressure to the supply holes 40*a* to 40*t*, and since the communication distances of the communication hole paths 60*a* to 60*t* are substantially equal to each other, the coating material is discharged from the discharge holes 50*a* to 50*t* with the same timing. In this way, the coating device 1 (coating nozzle 10) can perform highly accurate discharge on the target T.

In the present embodiment, in the coating device 1 (coating nozzle 10), the coating material is supplied from the same (one) chamber portion 30 to the supply holes 40*a* to 40*t*. In this way, the coating device 1 (coating nozzle 10) stops the discharge of the coating material from the discharge holes 50*a* to 50*t* with the same timing.

In the present embodiment, as the discharge holes 50*a* to 50*t* are located closer to the first position 45, the discharge holes 50*a* to 50*t* communicate with the supply holes which are located farther from the straight line L that is the reference line. In this way, the communication distances of the communication hole paths 60*a* to 60*t* which make the supply holes communicate with the discharge holes can be easily and reliably made equal to each other, and thus the above effects are more reliably achieved.

In the present embodiment, in the coating device 1 (coating nozzle 10), the distance F1 from one end to the other end of the discharge holes 50*a* to 50*t* which are formed so as to be aligned on the substantially straight line L is longer than the diameter F2 of the circle D where the supply holes 40*a* to 40*t* are formed so as to be aligned.

In this way, the coating device 1 (coating nozzle 10) can coat, with the coating material, a region which is longer than a (length in a predetermined direction) region where the supply holes 40*a* to 40*t* are formed. In this way, with the coating device 1 (coating nozzle 10), it is possible to solve problems that occur in a coating device (coating nozzle) in which a distance from one end to the other end of a plurality of discharge holes is longer than the length of a region in a predetermined direction where a plurality of supply holes are formed. In this way, in the coating device 1 (coating nozzle 10), as compared with the distance F1 from one end to the other end of the discharge holes 50*a* to 50*t*, the length of the diameter of the chamber portion 30 and the like can be reduced. In this way, it is possible to reduce the size of the coating device 1 (coating nozzle 10).

In the present embodiment, in the coating device 1 (coating nozzle 10), the supply surface 35 is formed concentrically with the first position 45 in the center which is the center of the circle D where the supply holes 40*a* to 40*t* are arranged. In this way, the coating device 1 (coating nozzle 10) can supply the coating material to the supply holes 40*a* to 40*t* with a more uniform pressure.

In the present embodiment, in the coating device 1 (coating nozzle 10), the communication hole paths 60*a* to 60*t* intersect the normal to the discharge surface 20. In this way, the coating device 1 (coating nozzle 10) can be adjusted such that the communication distances of the communication hole paths 60*a* to 60*t* are substantially equal to each other.

In the present embodiment, in the coating device 1 (coating nozzle 10), the discharge holes 50*a* to 50*t* are arranged so as to be aligned on the straight line L perpendicular to the normal which is extended vertically from the first position 45 to the discharge surface 20. In this way, the coating device 1 (coating nozzle 10) is easily adjusted such that the communication distances of the communication hole paths 60*a* to 60*t* are substantially equal to each other.

In the present embodiment, in the coating device 1 (coating nozzle 10), the supply holes 40*a* to 40*t* are substantially spaced in the circumferential direction of the circle D and are substantially equal to each other in diameter. In this way, in the coating nozzle 10, the pressure of the coating material in the supply holes 40*a* to 40*t* is uniform, and this facilitates the discharge of the coating material from the discharge holes 50*a* to 50*t* with the same timing.

In the present embodiment, in the coating device 1 (coating nozzle 10), the discharge holes 50*a* to 50*t* are substantially spaced in the direction of the straight line L and are substantially equal to each other in diameter. This facilitates, in the coating nozzle 10, the discharge of the coating material from the discharge holes 50*a* to 50*t* with the same timing.

Second Embodiment

Figure 7:
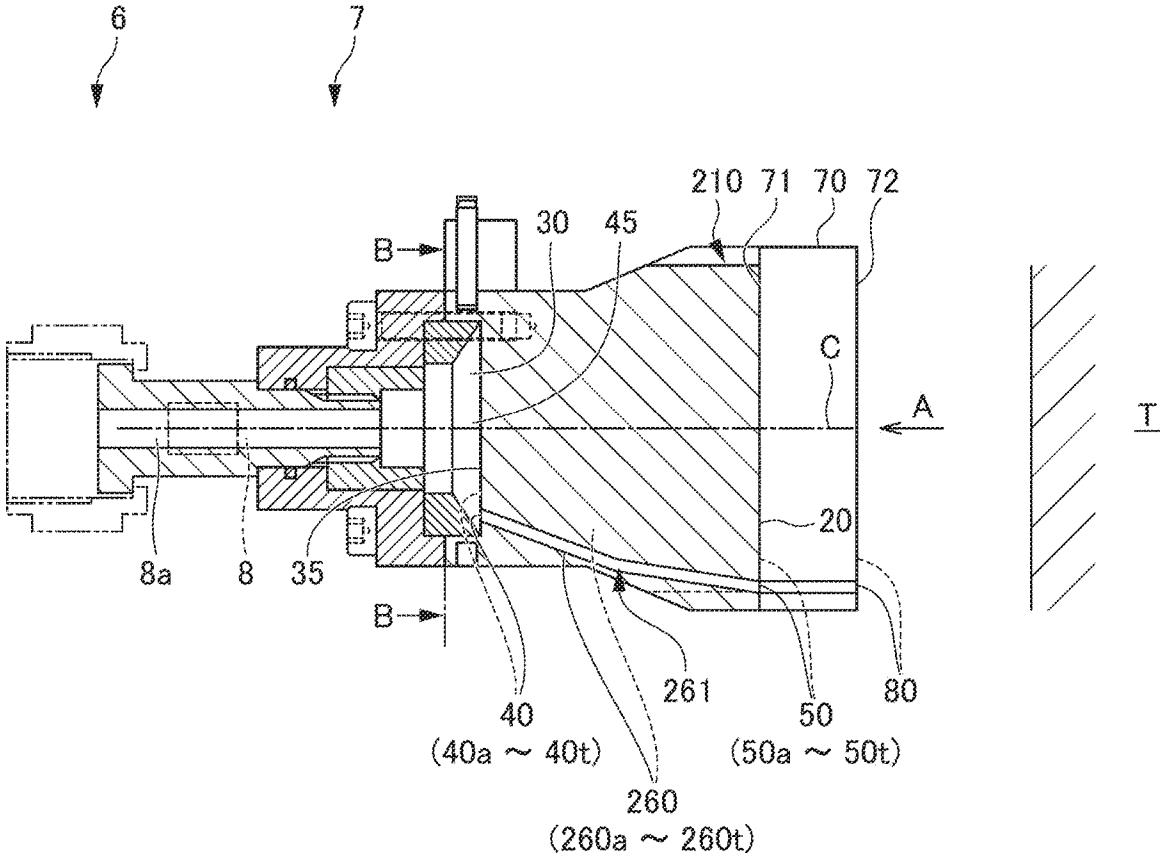
FIG. 7 is a cross-sectional view showing the configuration of a coating nozzle according to a second embodiment.

FIG. 7 is a cross-sectional view showing the configuration of a coating nozzle 210 according to a second embodiment of the present invention. As shown in FIG. 7, the coating nozzle 210 according to the second embodiment has the same configuration as the coating nozzle 10 according to the first embodiment except that the configuration of communication hole paths 260*a* to 260*t* forming a communication hole path group 260 differs therefrom. In FIG. 7, the same configurations as in the first embodiment are identified with the same reference numerals.

Specifically, the communication hole paths 60*a* to 60*t* forming the communication hole path group 60 in the coating nozzle 10 according to the first embodiment are formed linearly whereas the communication hole paths 260*a* to 260*t* forming the communication hole path group 260 in the coating nozzle 210 according to the second embodiment are extended linearly from the supply holes 40*a* to 40*t* forming the supply hole group 40, are thereafter bent halfway through and are extended linearly from a bent portion 261 toward the discharge holes 50*a* to 50*t* forming the discharge hole group 50. Each of the communication hole paths 260*a* to 260*t* may be configured so as to include the bent portion 261 or only part of the communication hole paths may be configured so as to include the bent portion 261. In any case, the communication hole paths 260*a* to 260*t* are set as in the first embodiment such that the communication distances (lengths) thereof are substantially equal to each other.

According to the present embodiment, in addition to the effects of the first embodiment, the following effects are achieved.

Specifically, according to the present embodiment, since at least part of the communication hole paths 260*a* to 260*t* is configured so as to include the bent portion 261, it is possible to avoid the interference of the communication hole paths with each other. As compared with the case where all the communication hole paths are formed linearly, at least part of the communication hole paths 260*a* to 260*t* is configured so as to include the bent portion 261, and thus the flexibility of a layout is enhanced, with the result that the processing of the coating nozzle is easily performed.

Third Embodiment

Figure 8:
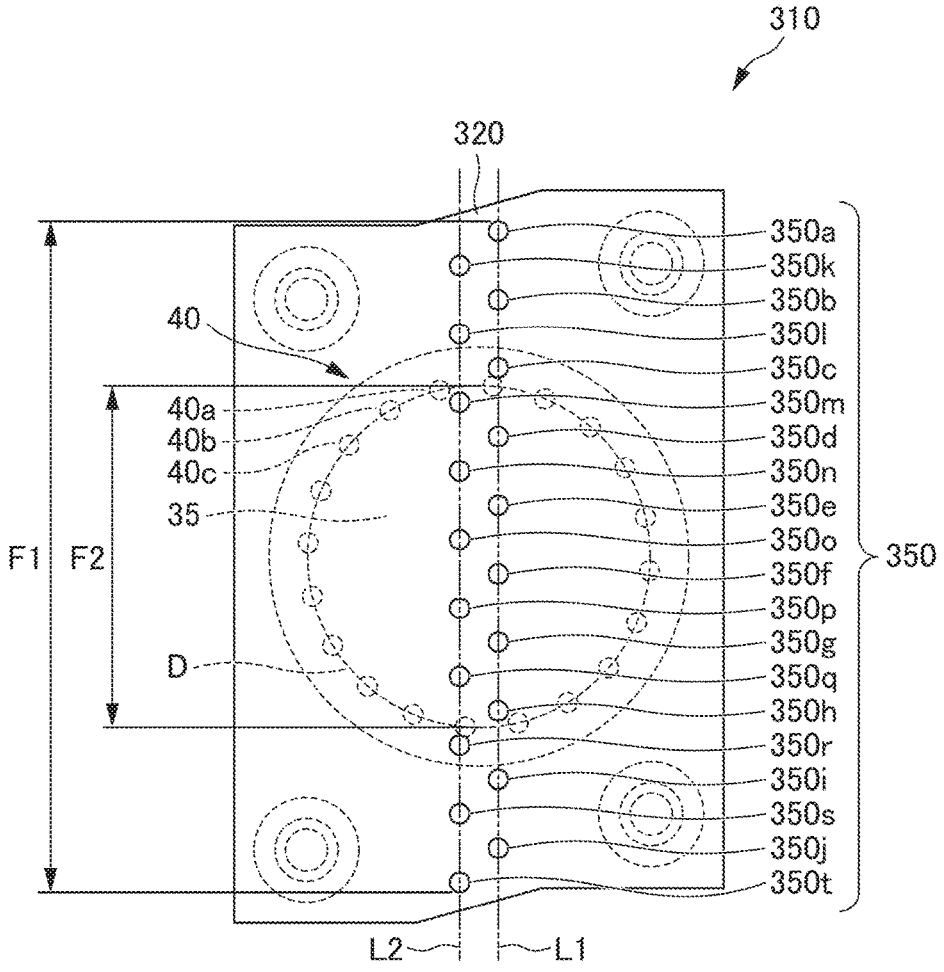
FIG. 8 is a diagram when a coating nozzle according to a third embodiment is viewed from a tip end side perpendicular to a discharge surface, and is also a perspective view illustrating the configuration of the coating nozzle.

FIG. 8 is a diagram when a coating nozzle 310 according to a third embodiment is viewed from a tip end side perpendicular to a discharge surface 320, and is also a perspective view illustrating the configuration of the coating nozzle 310. However, in FIG. 8, for convenience, the attachment is unillustrated. The coating nozzle 310 according to the third embodiment has the same configuration as in the first embodiment except that the arrangement of discharge holes 350*a* to 350*t* forming a discharge hole group 350 in the discharge surface 320 differs from the coating nozzle 10 according to the first embodiment. In FIG. 8, the same configurations as in the first embodiment are identified with the same reference numerals.

Specifically, the discharge holes 50*a* to 50*t* forming the discharge hole group 50 in the coating nozzle 10 according to the first embodiment are arranged on the one straight line L whereas the discharge holes 350*a* to 350*t* forming the discharge hole group 350 in the coating nozzle 310 according to the third embodiment are separated into two groups of 10 pieces, and they are individually arranged on two straight lines L1 and L2 which are parallel to each other a predetermined distance apart. On each of the straight lines L1 and L2, the discharge holes are spaced with a predetermined pitch. The discharge holes on the straight line L1 and the discharge holes on the straight line L2 are displaced from each other a half pitch in the direction of the straight lines.

A plurality of communication hole paths which make the supply holes 40*a* to 40*t* communicate with the discharge holes 350*a* to 350*t* and which are not shown in the figure are set as in the first embodiment such that the communication distances (lengths) thereof are substantially equal to each other. As in the first embodiment, the distance F1 in the direction of the straight lines from one end to the other end of the discharge holes which are formed so as to be aligned on the straight lines L1 and L2 is set longer than the diameter F2 of the circle where the supply holes are formed so as to be aligned.

According to the present embodiment, in addition to the effects of the first embodiment, the following effects are achieved.

Specifically, according to the present embodiment, the discharge holes 350*a* to 350*t* forming the discharge hole group 350 in the coating nozzle 310 are separated into the two groups of 10 pieces, and they are individually arranged on the two straight lines L1 and L2 which are parallel to each other the predetermined distance apart, with the result that it is possible to acquire a large distance between the discharge holes. Hence, it is possible to prevent the occurrence of a problem in which the distance between the discharge holes is excessively narrowed to cause a failure in the discharge of the coating material, and the processing of the coating nozzle is easily performed.

Fourth Embodiment

Figure 9:
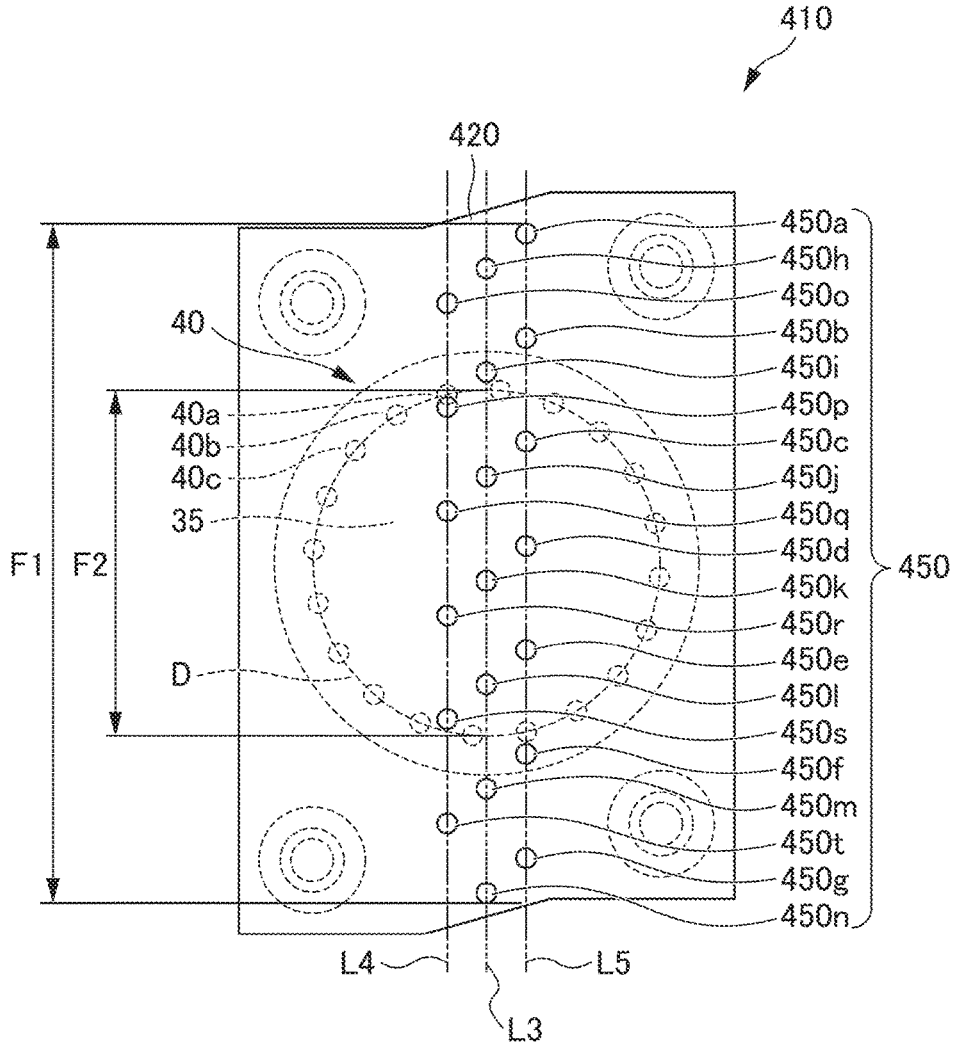
FIG. 9 is a diagram when a coating nozzle according to a fourth embodiment is viewed from a tip end side perpendicular to a discharge surface, and is also a perspective view illustrating the configuration of the coating nozzle.

FIG. 9 is a diagram when a coating nozzle 410 according to a fourth embodiment of the present invention is viewed from a tip end side perpendicular to a discharge surface 420, and is also a perspective view illustrating the configuration of the coating nozzle 410. However, in FIG. 9, for convenience, the attachment is unillustrated. The coating nozzle 410 according to the fourth embodiment has the same configuration as in the first embodiment except that the arrangement of discharge holes 450*a* to 450*t* forming a discharge hole group 450 in the discharge surface 420 differs from the coating nozzle 10 according to the first embodiment. In FIG. 9, the same configurations as in the first embodiment are identified with the same reference numerals.

Specifically, the discharge holes 50*a* to 50*t* forming the discharge hole group 50 in the coating nozzle 10 according to the first embodiment are arranged on the one straight line L whereas the discharge holes 450*a* to 450*t* forming the discharge hole group 450 in the coating nozzle 410 according to the fourth embodiment are separated into three groups, that is, a group of 7 pieces, a group of 6 pieces and a group of 7 pieces, and they are individually arranged on three straight lines L3, L4 and L5 which are parallel to each other only a predetermined distance apart. On each of the straight lines L3, L4 and L5, the discharge holes are spaced with a predetermined pitch. The discharge holes on the adjacent straight lines are displaced from each other in the direction of the straight lines. In this way, even when the coating nozzle 10 is moved in a direction perpendicular to the straight lines, the coating materials discharged from the discharge holes are prevented from overlapping each other.

A plurality of communication hole paths which make the supply holes 40*a* to 40*t* communicate with the discharge holes 450*a* to 450*t* and which are not shown in the figure are set as in the first embodiment such that the communication distances (lengths) thereof are substantially equal to each other. As in the first embodiment, the distance F1 in the direction of the straight lines from one end to the other end of the discharge holes which are formed so as to be aligned on the three straight lines L3, L4 and L5 is set longer than the diameter F2 of the circle where the supply holes are formed so as to be aligned.

According to the present embodiment, the same effects as in the third embodiment are achieved.

The present invention is not limited to the embodiments described above, and variations, modifications and the like which can achieve the objects of the present invention are included in the present invention.

Although in the present embodiment, the coating nozzle 10 includes the 20 supply holes, the 20 discharge holes and the 20 communication hole paths, there is no limitation to this configuration, and each of the numbers of supply holes, discharge holes and communication hole paths may be less than 20 or more than 20. The numbers of supply holes, discharge holes and communication hole paths can be freely set according to the area of a coated region in the target (for example, a vehicle body) and the required accuracy of the coating.

Although in the present embodiment, the coating device 1 includes the one coating nozzle, there is no limitation to this configuration, and the coating device 1 may include a plurality of coating nozzles.

Although in the present embodiment, the coating material is a paint, there is no limitation to this configuration, and the coating material may be, for example, a vibration damping material or an adhesive.

EXPLANATION OF REFERENCE NUMERALS

1: coating device
2: articulated robot
8: coating material supply portion
8*a*: coating material supply pipe
10: coating nozzle
20: discharge surface
30: chamber portion
35: supply surface
40*a* to 40*t*: supply hole
50*a* to 50*t*: discharge hole
60*a* to 60*t*: communication hole path
D: circle
L: straight line
T: target

What is claimed is:

1. A coating nozzle which discharges a coating material supplied from a coating material supply portion, the coating nozzle comprising:

a discharge surface which is arranged opposite a coating target;

a chamber portion which communicates with the coating material supply portion;

a supply surface which forms an inner surface of the chamber portion and which is arranged substantially parallel to the discharge surface;

a plurality of supply holes which is formed, with a first position in a center, therearound in the supply surface;

a plurality of discharge holes which is formed in the discharge surface so as to be aligned on at least one substantially straight line; and a plurality of communication hole paths which make the supply holes respectively communicate with the discharge holes and whose communication distances are substantially equal to each other, wherein the plurality of supply holes is located in a narrow distribution area of the supply surface on a circle with the first position in the center, a diameter of the circle of the narrow distribution area being smaller than that of a distance from one end to the other end of the plurality of discharge holes which are aligned on the at least one substantially straight line, and wherein outlets of the plurality of discharge holes are distributed in the discharge surface on a straight line, in a side view and a front view, along the at least one substantially straight line.

2. The coating nozzle according to claim 1, wherein when the at least one substantially straight line that is a direction in which the plurality of discharge holes is arranged defines a reference line, as the plurality of discharge holes is located closer to the first position in the center, the plurality of discharge holes communicates with the supply holes which are located farther from the reference line.

3. The coating nozzle according to claim 1, wherein the supply surface is formed concentrically with the first position in the center which is the center of the circle on which the plurality of supply holes is arranged.

4. The coating nozzle according to claim 1, wherein the communication hole paths intersect a normal to the discharge surface.

5. The coating nozzle according to claim 1, wherein the plurality of discharge holes is arranged so as to be aligned on at least one straight line which is perpendicular to a normal that is extended vertically from the first position to the discharge surface.

6. The coating nozzle according to claim 1, wherein the plurality of supply holes is substantially spaced in a circumferential direction of the circle and are substantially equal to each other in diameter.

7. The coating nozzle according to claim 1, wherein the plurality of discharge holes is substantially spaced in a direction of the straight line and are substantially equal to each other in diameter.

8. A coating device comprising:

a coating material supply portion; and the coating nozzle according to claim 1.

9. The coating nozzle according to claim 1, further comprising:

a flow regulation block having a plurality of vertical penetration holes which are extended vertically through inside of a block main body thereof, wherein the plurality of vertical penetration holes are formed so as to coincide with the position of the plurality of discharge holes respectively, thereby communicating with the plurality of discharge holes so as to regulate the direction of the flow of the material to the vertical direction.

* * * * *